US012714210B2

(12) United States Patent
Mui et al.

(10) Patent No.: US 12,714,210 B2
(45) Date of Patent: Aug. 25, 2026

(54) APPARATUS AND METHOD FOR CARRYING AND STORING FOOTWEAR

(71) Applicants: Lok Yee Mui, Boston, MA (US); Matthew Stewart Kressy, Wellesley, MA (US); Axel Kilian, Cambridge, MA (US)

(72) Inventors: Lok Yee Mui, Boston, MA (US); Matthew Stewart Kressy, Wellesley, MA (US); Axel Kilian, Cambridge, MA (US)

( * ) Notice: Subject to any disclaimer, the term of this patent is extended or adjusted under 35 U.S.C. 154(b) by 93 days.

(21) Appl. No.: 18/632,496

(22) Filed: Apr. 11, 2024

(65) Prior Publication Data

US 2024/0251919 A1 Aug. 1, 2024

Related U.S. Application Data

(63) Continuation-in-part of application No. 17/571,974, filed on Jan. 10, 2022, now Pat. No. 11,974,656.
(Continued)

(51) Int. Cl.
*A45C 3/12* (2006.01)
*A45C 3/00* (2006.01)
(Continued)

(52) U.S. Cl.
CPC ..... *A45C 3/12* (2013.01); *A45C 3/001* (2013.01); *A45C 13/30* (2013.01); *A45F 5/10* (2013.01);
(Continued)

(58) Field of Classification Search
CPC ..... A45F 3/14; A45F 2200/05
See application file for complete search history.

(56) References Cited

U.S. PATENT DOCUMENTS 2,428,074 A 9/1947 Hanson
2,679,937 A 6/1954 Fulster
(Continued)

FOREIGN PATENT DOCUMENTS

JP 2551256 B2 11/1996

OTHER PUBLICATIONS

GB-2556883-A; Inventor: Liebman, Miriam; "Apparatus For Transportation and Storage of Footwear"; CPC Classification: A45C13/30; Country: Great Britian; Published: Jun. 13, 2018 (Year: 2018).*

*Primary Examiner* — Nathan J Newhouse
*Assistant Examiner* — Lester L Vanterpool
(74) *Attorney, Agent, or Firm* — Wiggin and Dana LLP

(57) ABSTRACT

A system for carrying food apparel including a device made of a continuous strip of material forming two or more loops and an interlocking member that when moved chases the diameter of the loops. The device contracts around shoes at various points including the mid sole region or the heels. The device is attachable to, for example, a travel bag, wrist-band, or shoulder band. The device may be attachable through, for example, a magnet, button, hook-and-loop fastener, zippers, clips, or carabiner. In addition, disclosed is a method of carrying foot apparel involving providing the device, placing a foot apparel into each loop of the device, tightening the loops, and attaching the loops to the exterior of a bag, hand strap, wrist strap, or shoulder strap.

20 Claims, 11 Drawing Sheets

Related U.S. Application Data

(60) Provisional application No. 63/135,728, filed on Jan. 10, 2021.

(51) Int. Cl.
*A45C 13/30* (2006.01)
*A45F 5/00* (2006.01)
*A45F 5/10* (2006.01)

(52) U.S. Cl.
CPC .. *A45C 2003/002* (2013.01); *A45C 2013/306* (2013.01); *A45F 2005/006* (2013.01); *A45F 2005/008* (2013.01)

(56) References Cited

U.S. PATENT DOCUMENTS 3,003,727 A 10/1961 Medor
3,587,951 A 6/1971 Derouin
3,865,339 A 2/1975 Von Alven
3,931,948 A 1/1976 Mason, Jr.
4,244,498 A 1/1981 Copp
4,629,103 A 12/1986 Miller
4,790,462 A 12/1988 Kawaguchi
4,815,642 A 3/1989 Ray
4,867,359 A 9/1989 Donovan
5,050,999 A * 9/1991 Van Loon, III ..... A45C 3/045 493/239
5,282,553 A 2/1994 Ibled
5,285,939 A 2/1994 Hogan
5,425,485 A 6/1995 Carlo
5,511,754 A 4/1996 Johannsen
5,513,787 A 5/1996 Reed
5,582,337 A 12/1996 McPherson
D387,396 S 12/1997 Chao
5,699,564 A * 12/1997 Heh ..... A47D 15/00 220/495.1
5,746,685 A 5/1998 Glaser
5,779,036 A 7/1998 Westbrook
5,908,206 A 6/1999 Lopresti, Jr.
D413,078 S 8/1999 Hanson
6,446,849 B1 9/2002 Schleifer
6,467,665 B1 * 10/2002 Jenkins ..... A45F 3/04 224/628
6,869,219 B1 * 3/2005 Sala ..... A45C 3/12 383/117
D504,014 S * 4/2005 Lampley ..... D3/257
7,662,073 B1 2/2010 Baldwin
8,393,016 B2 3/2013 Wilkins-Gaudio
D687,635 S * 8/2013 Choi ..... A45C 3/12 D3/317
8,505,755 B2 8/2013 Greenberg
9,770,086 B2 9/2017 Prisco
D826,560 S 8/2018 Prisco
D826,561 S 8/2018 Prisco
D826,562 S 8/2018 Prisco
D826,563 S 8/2018 Prisco
D826,564 S 8/2018 Prisco
D840,154 S 2/2019 Prisco
10,244,853 B2 4/2019 Friedberg
10,662,024 B2 * 5/2020 Kirkham ..... B65H 75/364
11,089,851 B2 8/2021 Leaks, Jr.
11,229,277 B1 1/2022 Davies
D991,682 S * 7/2023 Fernandez ..... A45C 13/02 D3/317
2005/0194803 A1 9/2005 Perry
2007/0033713 A1 2/2007 Carreon
2007/0039841 A1 2/2007 Deloatch-Ratliff
2007/0272570 A1 11/2007 Brooks
2008/0011567 A1 * 1/2008 Hammond ..... A45C 7/009 206/278
2011/0101052 A1 * 5/2011 Armstrong ..... A45C 13/30 224/254
2011/0204107 A1 8/2011 Lemert
2012/0210600 A1 8/2012 Joubert
2015/0230574 A1 * 8/2015 Rorie ..... A45C 7/0086 190/111
2016/0278440 A1 * 9/2016 Kaspi ..... A41B 11/002
2016/0338473 A1 11/2016 Clews
2017/0143104 A1 * 5/2017 Vera ..... A45C 3/12
2017/0164721 A1 6/2017 Forney
2017/0172287 A1 6/2017 Prisco
2018/0310696 A1 11/2018 Getter
2019/0246774 A1 8/2019 Becht
2019/0254396 A1 * 8/2019 Leaks, Jr. ..... A45C 3/12
2019/0269210 A1 * 9/2019 Melamed ..... A45C 13/02

* cited by examiner

APPARATUS AND METHOD FOR CARRYING AND STORING FOOTWEAR

CROSS-REFERENCE TO RELATED APPLICATIONS

This application is a continuation-in-part of Non-provisional application Ser. No. 17/571,974 filed on Jan. 10, 2022, and entitled "APPARATUS AND METHOD FOR CARRYING AND STORING FOOTWEAR", which claims the benefit of priority of U.S. Provisional Patent Application Ser. No. 63/135,728, filed on Jan. 10, 2021, and titled "Apparatus and method for footwear carrying and storing", each of which is incorporated by reference herein in its entirety.

FIELD OF THE INVENTION

The present invention generally relates to the field of devices for carrying and storing footwear. In particular, the present invention is directed to apparatus and method for carrying and storing footwear.

BACKGROUND

Often times, women bring an extra pair of flats to change while in heels, and vice versa, during commute. Occasions include but are not limited to wedding events, clubbing, conferences, or going to work. However, the process of carrying is bothersome. We may run out of space to carry them, it can get cumbersome, we may lose them, or the plastic bags we use to carry the shoes are unpresentable. On the other hand, it was found that men also have their hectic issues in carrying dress shoes during travelling or communing.

SUMMARY OF THE DISCLOSURE

In an aspect, a system for carrying foot apparel may include a central frame; a first mesh frame; a first elastic band looped around the first mesh frame forming a first mesh on the interior of the first mesh frame, wherein the first mesh comprises a first central hole; a first strap which forms a loop from the inside of the first central hole to the first mesh frame, and which is attached to the central frame; a second mesh frame; a second elastic band looped around the second mesh frame forming a second mesh on the interior of the second mesh frame, wherein the second mesh comprises a second central hole; and a second strap which forms a loop from the inside of the second central hole to the second mesh frame, and which is attached to the central frame.

In another aspect, an apparatus of carrying foot apparel may include a central frame; at least one mesh frame; at least an elastic band looped around the at least one mesh frame, forming a mesh on the interior of the at least one mesh frame, wherein the mesh comprises a central hole; and at least a strap which forms a loop from the inside of the central hole to the at least one mesh frame, and which is attached to the central frame.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

Figure 1:
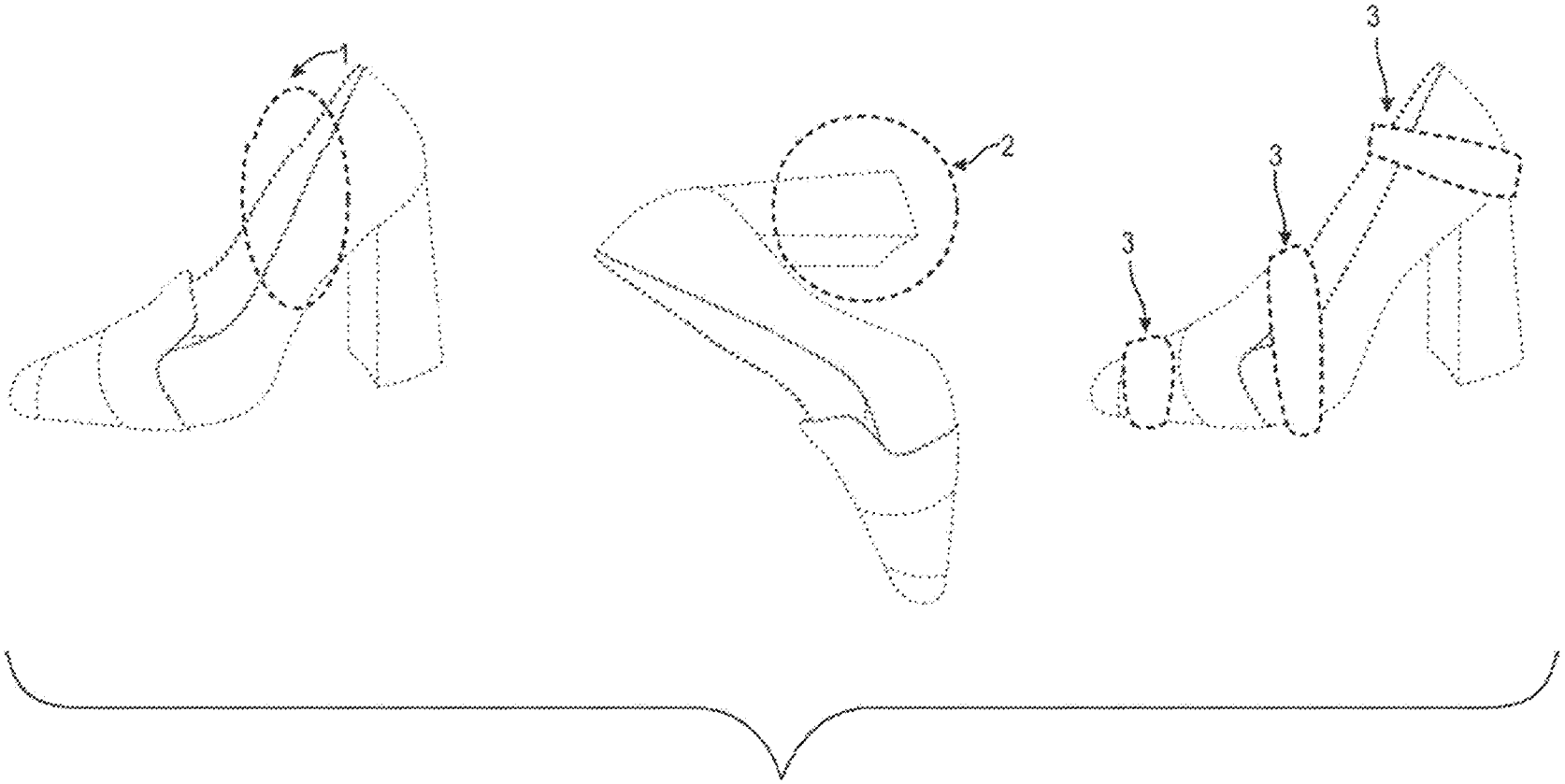
FIG. 1 is a schematic representation indicating the location(s) at which the strapping occurs along the shoe.
Figure 2:
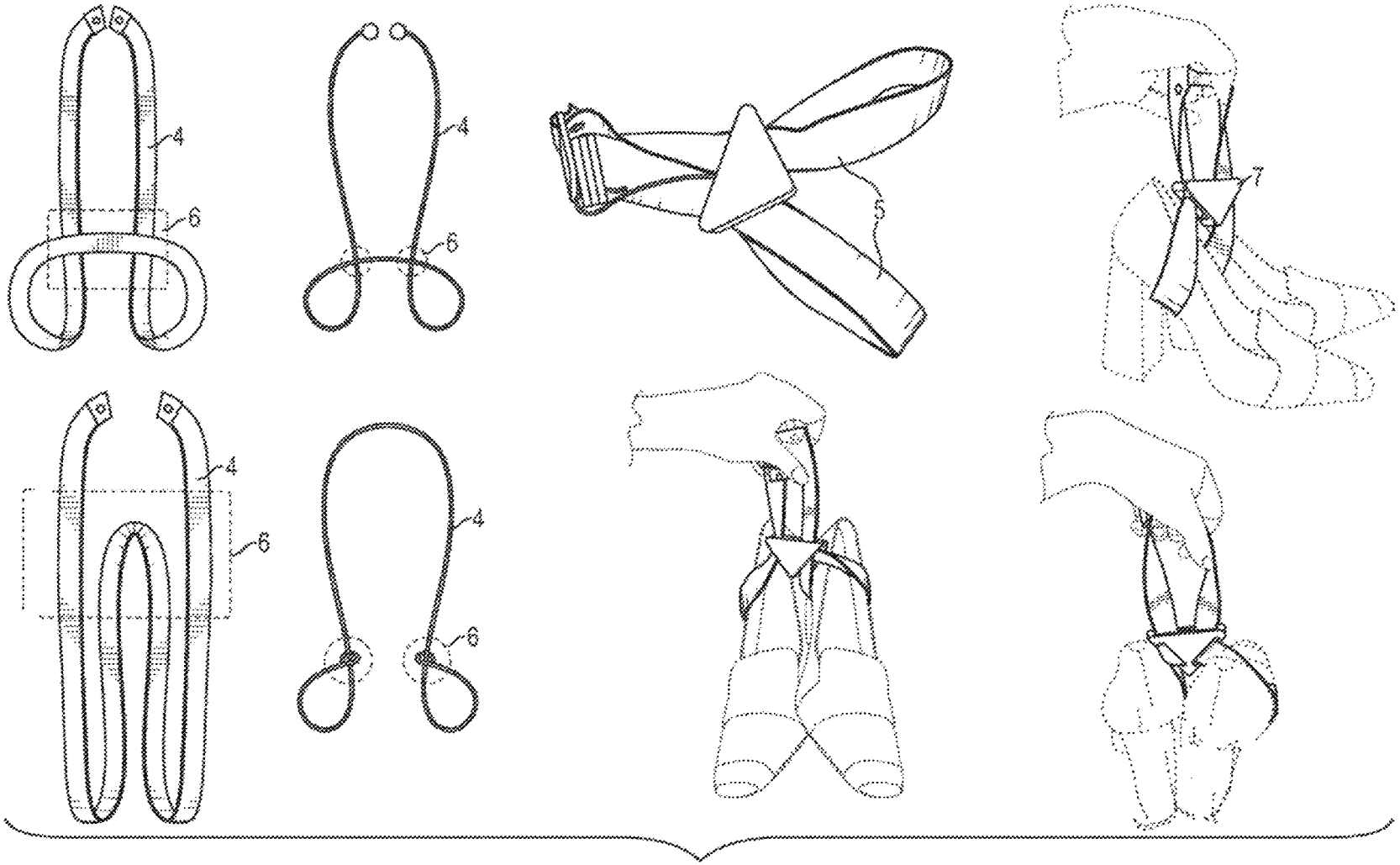
FIG. 2 is a schematic representation of an embodiment in which the continuous strip of material forming a pair of loops.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

The purpose and advantages of the disclosed subject matter will be set forth in the description below. Additional advantages of the disclosed subject matter will be realized by the specific embodiments disclosed in the written description, claims and included drawings.

To achieve these advantages as well as others relating to the purpose of the disclosed subject matter as embodied and described, the disclosed subject matter includes convenient, and effective apparatus and method for carrying and storing footwear, in particular a device for carrying and storing various items including shoes.

The invention is a gadget that can hold shoes. This invention works by strapping around the shoes, through a strip of material or an opening within the materials. The grasp location can be at mid sole region, the heels or a number of supporting points along the shoes.

Another embodiment of this invention is that it is conjunct and can be attached to bags, wrist band and shoulder band. The method to attach can be but not limited to magnet, hook, button, velcro, zippers, clips or carabiner. This makes the carrying process accessible and alleviates space constraint inside the bag.

Another embodiment of this invention is that the gadget can enhance, polish up or build on the outfit of an individual through its material, color and ergonomic design. It is a fashion item that makes the carrying process gorgeous and interesting.

Another embodiment of this invention is that it can carry flats, sneakers or the like that the users wear to walk out after they switch to their heels or dress shoes at the occasion. Users can clasp the sneakers securely onto a hook, carabiner or the like and can store or cover them. This embodiment makes the changing process from comfort shoes to heels seamless.

Another embodiment of this invention is when the gadget is not in use, it is small or in a flat form and can be easily stored into bags or other containers without taking up much spaces. It is portable enough to facilitate daily use.

Another embodiment of this invention is that the gadget's attachment can hang the shoes onto any mediums that provide supports, such as hooks or sticks. The goal is to facilitate storage at home or at office.

Another embodiment of this invention is that it minimizes dress shoe damages through encouraging users only wear the dress shoes at the occasion venue as when carrying them is made easier.

It is to be understood that the general description and detailed description are exemplary and not intended to be limiting but instead for further explanation of the disclosed subject matter.

The included drawings, which constitute part of this specification, are provided to illustrate and help further the understanding of the product of the disclosed subject matter.

Reference will now be made in detail to exemplary embodiments of the disclosed subject matter, this embodiment is illustrated in the provided drawings.

Holding Locations

Referring now to FIG. 1, a schematic representation is provided which shows an exemplary embodiment of where the shoe is held in the embodiments of FIG. 2 to FIG. 6. The grasp can occur at mid-sole region 1, at any points along the heel 2, or evenly along the shoe body with multiple touch points 3.

Holding Via a Strip of Materials

Referring now to FIG. 1, a schematic representation is provided which shows a device which functions through holding the shoe with a continuous strip of material 4 that might be made of metal, fabric, leather, plastic or the like. The wiring of the strip forms two loops 5, one loop holds one shoe. The loops can be formed by either winding the strip around itself or using a rig to hold the strip of material in a particular wiring order. While the figure shows a limited number of wiring orders, it is not intended to restrict the scope of how the wiring shall be constructed, as long as it can form a pair of loops. The dotted line 6 represents the interlocking member, the knot, or the rig, where the length adjustment of the loops shall take place. The interlocking member can be of any sizes, shapes or materials. The friction created from the interlocking member, together with the weight of the strapped shoe, makes the grip secured 7. The strapping occurs at either mid-sole region of the shoes, or the heels.

Figure 3:
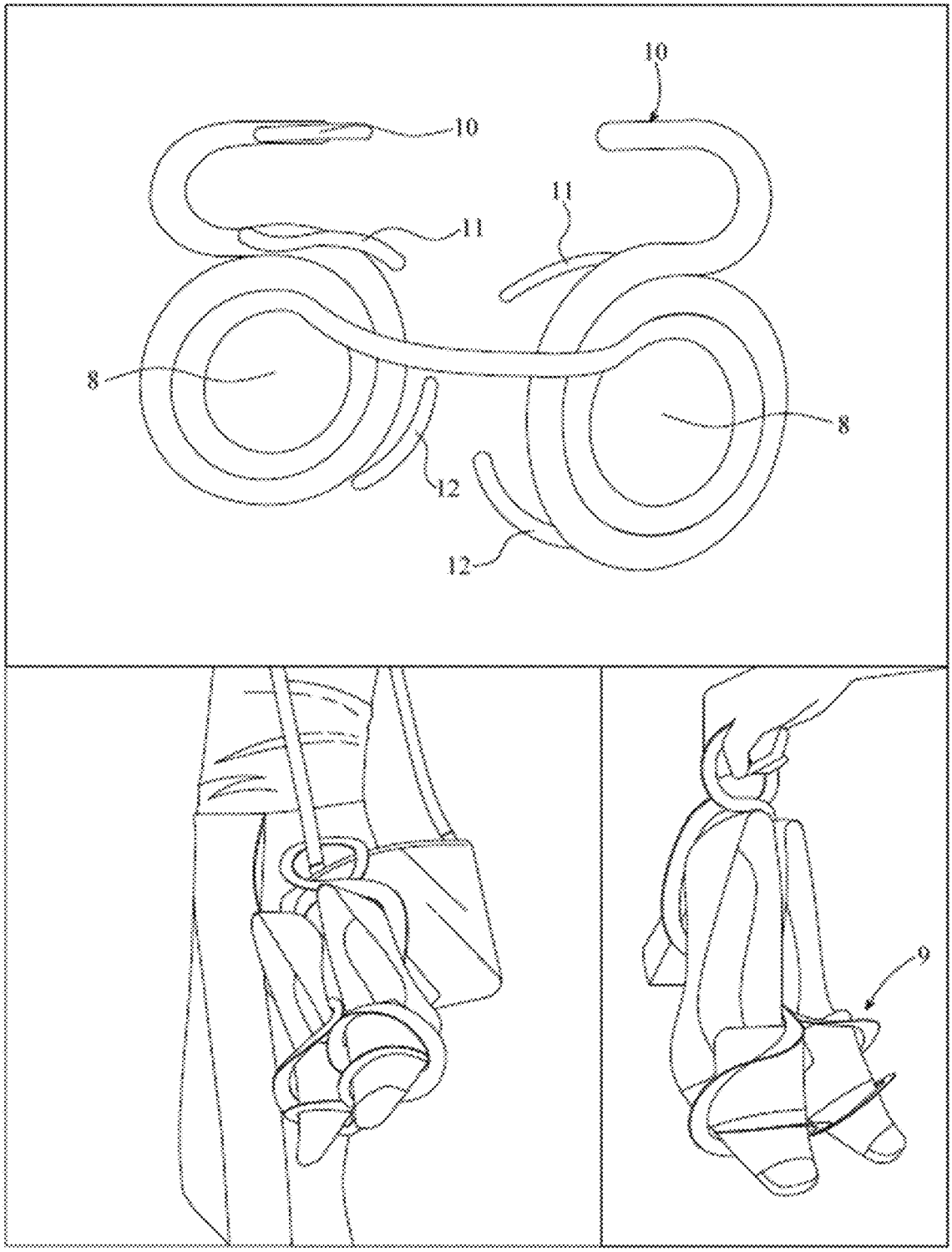
FIG. 3 is a schematic representation of an embodiment with a spiral pattern basic structure.

The embodiment in FIG. 3 functions through holding the shoe with a strip of pliable material. The material can be paper, plastic, wood, metal or the like as long as it is pliable enough to stretch and wrap around the shoes. The length of strand is directly proportional to the size of shoes. The strapping occurs at various points along the shoes to hold the shoe stably. The gadget when not in use is a flat sheet in spiral pattern, with a hole in the middle 8. Upon inserting shoe tips into the hole, the gadget's conformation changes to a 3D structure 9. The pair of structures are held together by hook-and-loop fastener at 10, 11 and 12.

Figure 4:
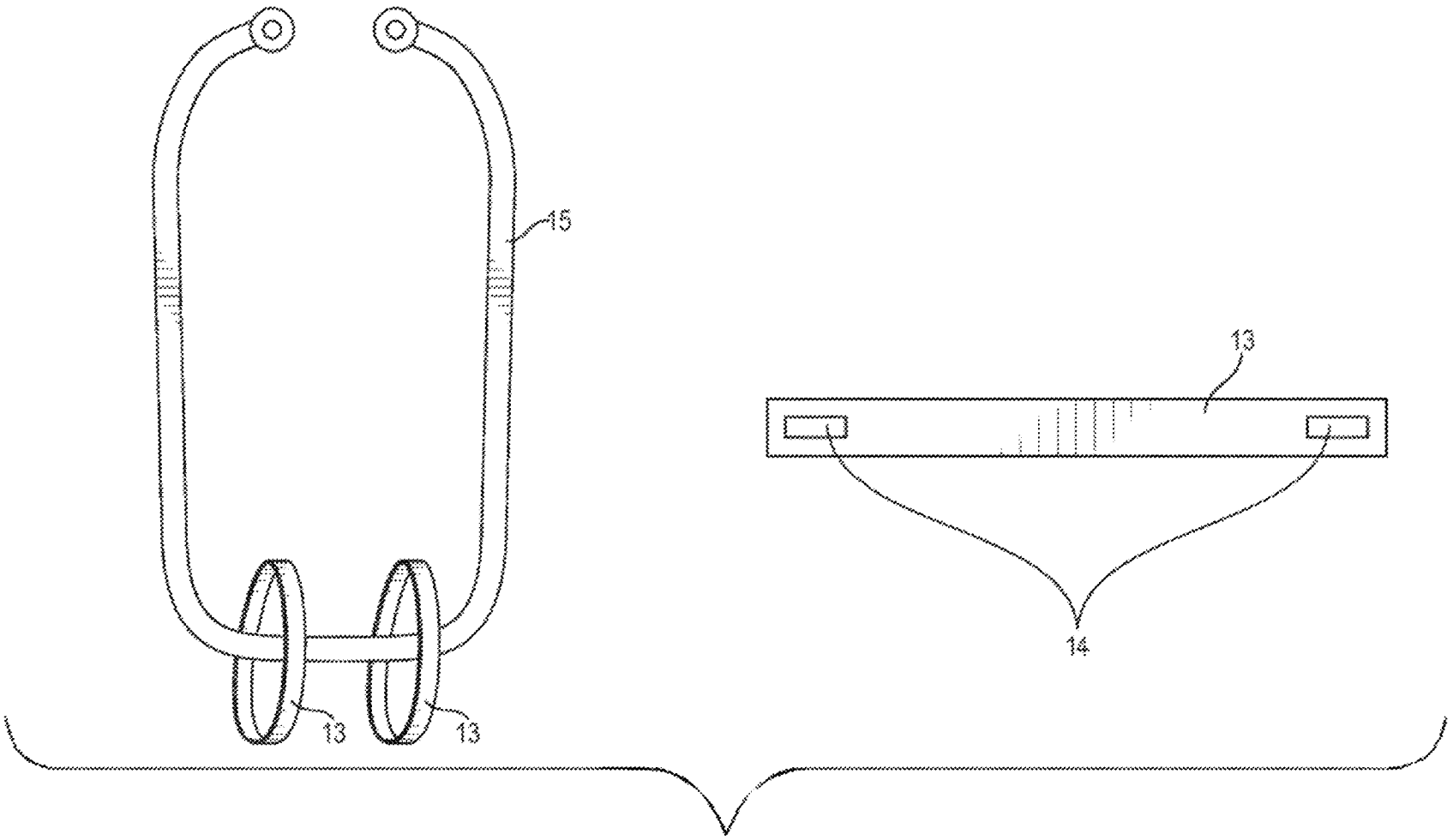
FIG. 4 is a schematic representation of an embodiment with a belt and a plurality of ring bands.

The embodiment in FIG. 4 functions through holding a shoe with a ring band 13. The band can be made of fabric, plastic, wood, metal or the like as long as it is malleable enough to coil around the target object. The ring can be formed by fastening the ends with button, hook-and-loop fastener, magnet or the like 14. A belt 15 holds the pair of bands in place by passing through them.

Holding Through an Opening Formed by Materials

Figure 5:
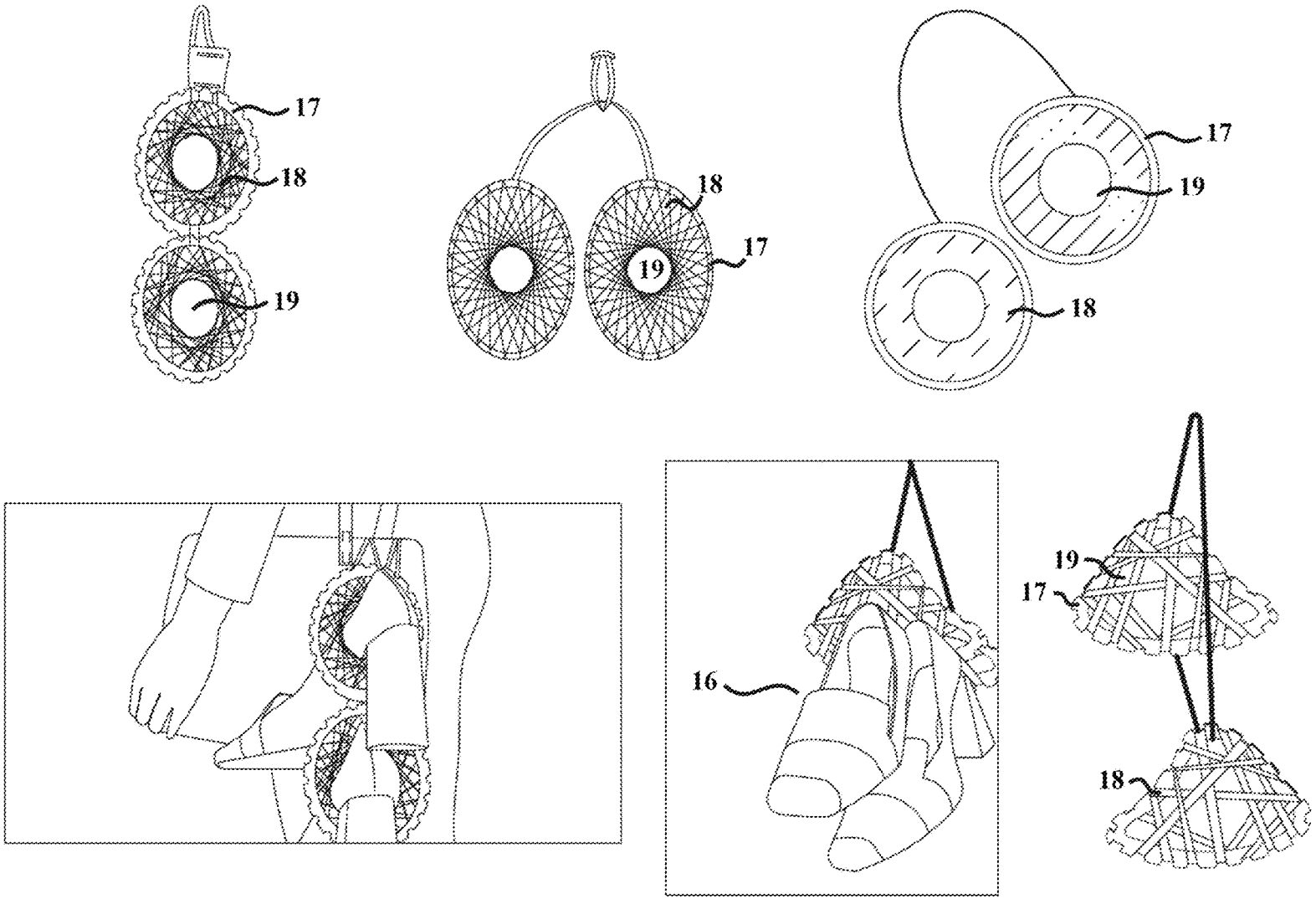
FIG. 5 is a schematic representation of an embodiment with an opening formed by elastic materials.

The embodiment in FIG. 5 functions through holding the shoes 16 at either midsole region or the heels with frames 17, each frame holds one shoe 16. The frame 17 can be in any shapes and sizes, with elastic bands or other stretchy materials wrapping around it 18. The elastic bands or materials wrap the frame in such a way that it provides an opening at the center of the frame for shoe insertion 19. The stretchiness of elastic materials allow the gadget to accommodate different sizes of objects.

Figure 6:
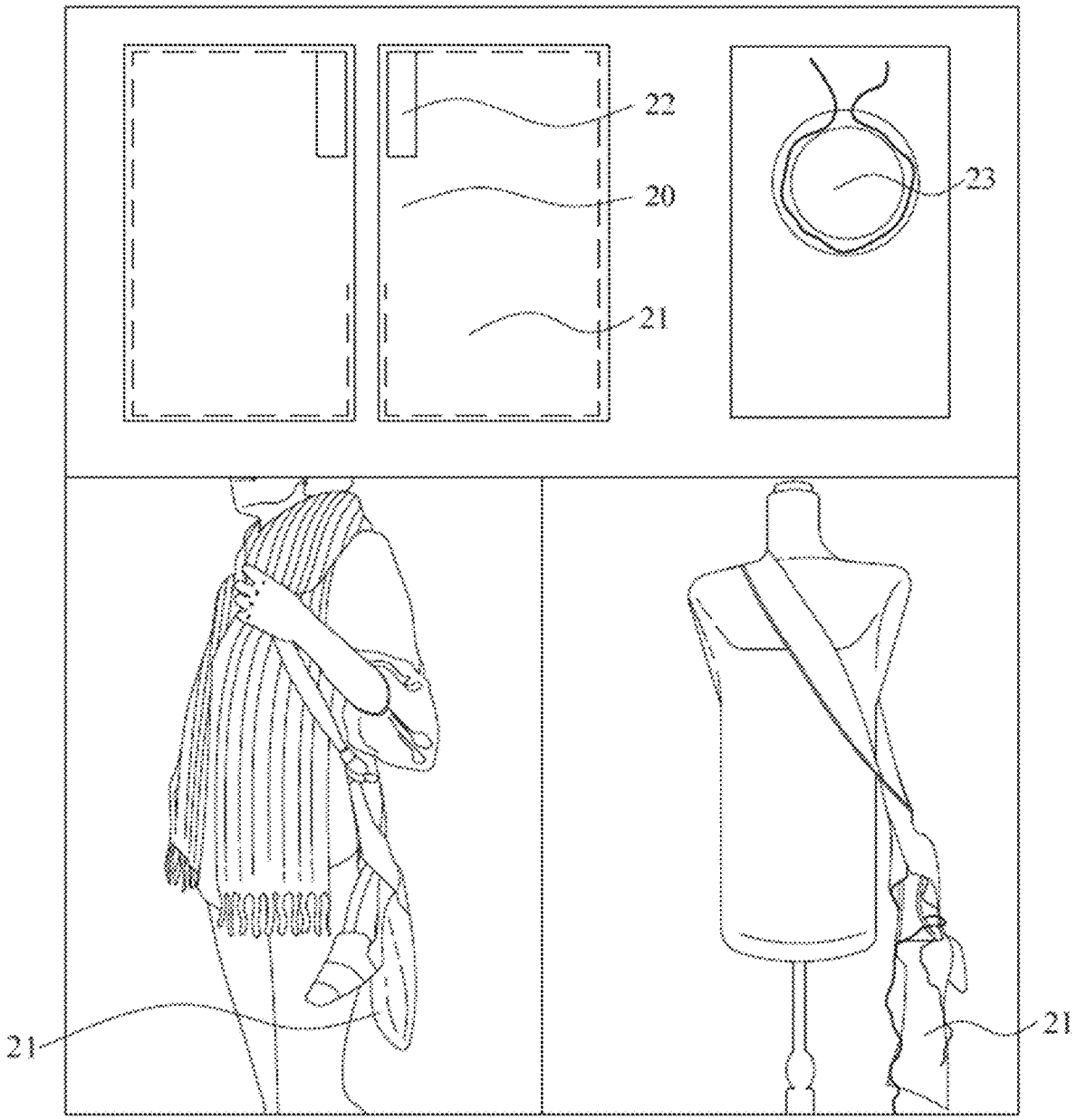
FIG. 6 is a schematic representation of an embodiment with an opening formed by a piece or pieces of cloths.

The embodiment in FIG. 6 functions through holding the mid-sole region of the shoes with an opening in fabric. Through sewing two pieces of fabrics together, an opening 20 and a pouch 21 are formed which the heels can be inserted into. The pouch can also serve to store flats or other comfort shoes. The dashed lines represent the sewing lines. The size of opening can be adjusted through either zipper, buttons, hook-and-loop fastener, string or the like 22. Alternatively, the opening can be a cut in the middle of fabric 23.

Attachment to Body and Carrying Style

Figure 7:
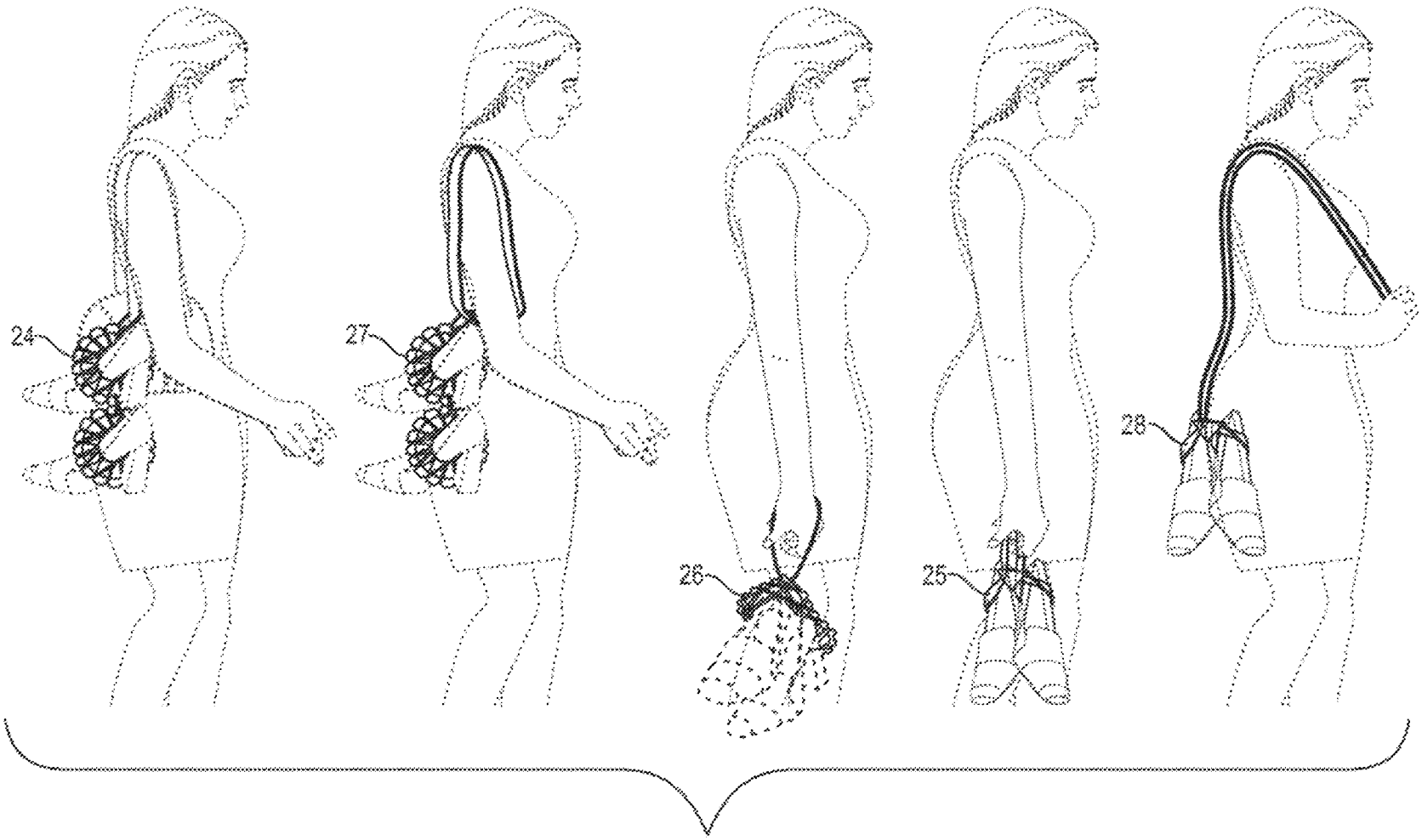
FIG. 7 is a schematic representation of the various mechanisms for carrying the object.

The embodiment in FIG. 7 shows the various ways on how the shoes can be carried, it can be connected to bag/luggage 24, hand held 25, wrist held 26, cross body 27, hung from the shoulder 28 or the like. The embodiments from FIG. 2 to FIG. 6 can be removably fastened to bag, hand strap, wrist strap, shoulder strap or the like through a fastener with magnets, buttons, hook-and-loop fastener, zippers, clips or the like.

Adapting Other Accessories

Figure 8:
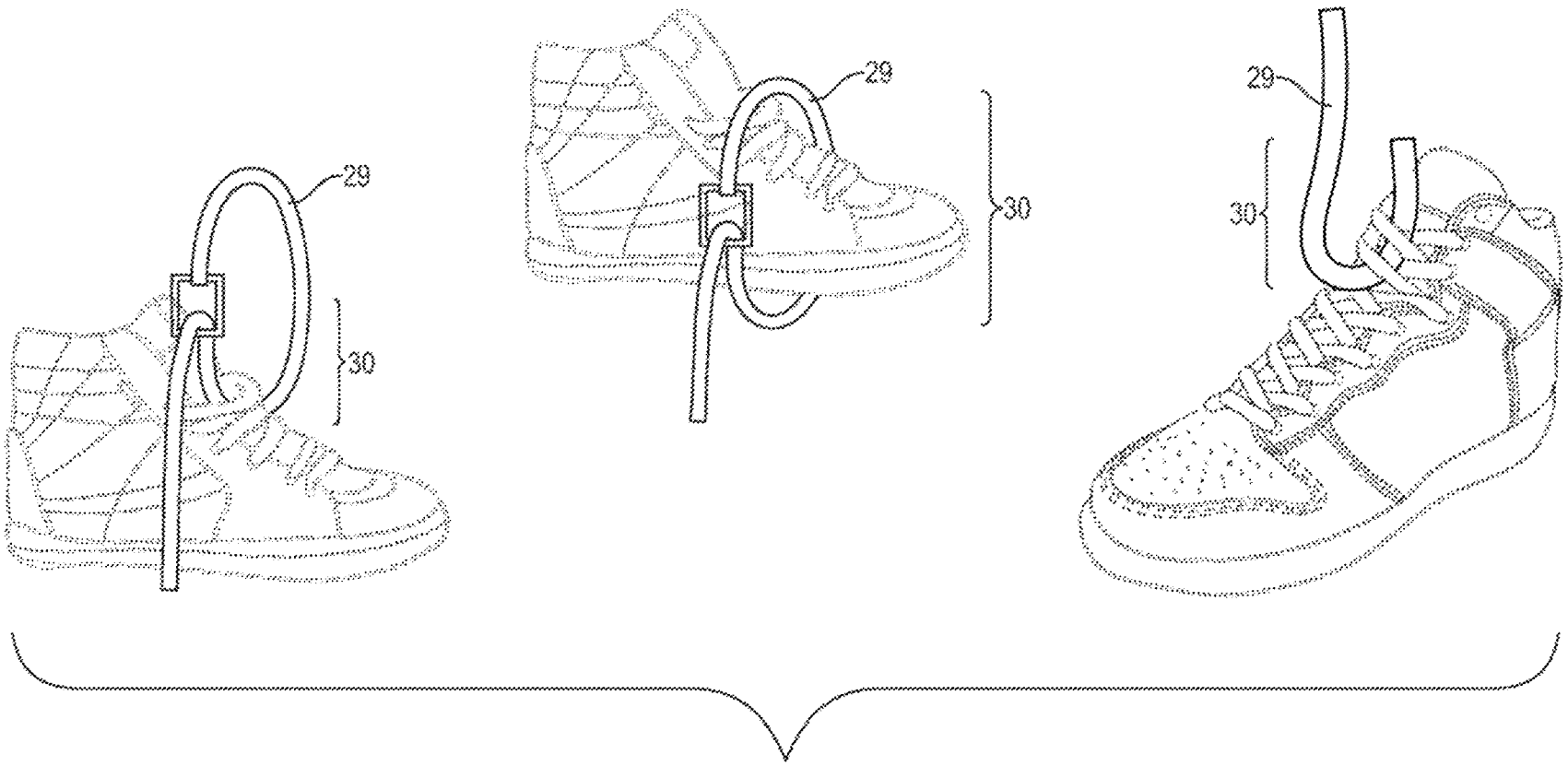
FIG. 8 is a schematic representation of various adaptions based on the object being carried.

FIG. 8 demonstrates that the invention is modular and can adapt other add-on accessories. For example, there can be a carabiner, strand, hook, clips or the like 29 to carry comfort shoes for changing, such as sneakers, flats or slippers. The holding can occur, but not limited to, at, shoelaces, shoe collar or mid-sole region 30. There can also be a folded pouch or piece of fabric that can be expanded to store or cover up the comfort shoes. The accessories can be attached to anywhere along the strand.

In some embodiments, a system for carrying foot apparel may include a continuous strip of material forming two or more loops, an interlocking member that when moved changes the diameter of the loops.

In some embodiments, a system for carrying foot apparel may include a bag, hand strap, wrist strap, shoulder strap of which continuous strip of material is attached to.

In some embodiments, a bag, hand strap, wrist strap, shoulder strap are attached to the continuous strip of material through one or more magnets, buttons, hook-and-loop fastener, zippers, buckles, snaps or clips.

In some embodiments, a system for carrying foot apparel may include a strand, a pouch or a piece of fabric, that can be formed by the continuous strip of material, or as an add-on member.

In some embodiments, two or more loops also comprise a support material to provide structure to the two or more loops.

In some embodiments, a system for carrying foot apparel may include a bag, hand strap, wrist strap, shoulder strap of which the continuous strip of material is attached to.

In some embodiments, bag, hand strap, wrist strap, shoulder strap are attached to the continuous strip of material through one or more magnets, buttons, hook-and-loop fastener, buckles, snaps, zippers, or clips.

In some embodiments, a system for carrying foot apparel may include a strand, a pouch or a piece of fabric, that can be formed by the continuous strip of material, or as an add-on member.

In some embodiments, a system for carrying foot apparel may include one or more hooks.

In some embodiments, a method for carrying foot apparel may include (a) Providing a system for carrying foot apparel comprising a continuous strip of material forming two or more loops, an interlocking member that when moved changes the diameter of the loops; (b) Placing a foot apparel each into one loop within the loop so that the loop tightens around each foot apparel; (c) Moving the interlocking member so that the loops tighten around each foot apparel; (d) Attaching the totality of the loops to the exterior of a bag, hand strap, wrist strap, or shoulder strap.

In some embodiments, loop tightens around a heel of foot apparel.

In some embodiments, two or more loops also comprise a support material to provide structure to the two or more loops.

In some embodiments, in step (d) the bag, hand strap, wrist strap, shoulder strap are attached to the continuous strip of material through one or more magnets, buttons, hook-and-loop fastener, zippers, snaps, buckles, or clips.

In some embodiments, in step (b) the loops are further adapted to form, or to attach a pouch, a strand or a piece of fabric to surround the foot apparel.

In some embodiments, in step (a) the system for carrying foot apparel has one or more hooks.

In some embodiments, hooks latch onto foot apparel by latching onto shoelaces or shoe collar of the foot apparel.

In some embodiments, in step (d) the totality of the loops is connected to the exterior of a bag.

In some embodiments, in step (d) the totality of the loops is connected to the exterior of a shoulder strap.

In some embodiments, in step (d) the totality of the loops is connected to the exterior of a hand strap.

In some embodiments, a system for carrying foot apparel may include a first frame having a single or a multiple of elastic band(s), each elastic band having a first end attached to one portion of the first frame, and a second end attached to a second portion of the first frame, wherein the plurality of elastic members creates a mesh that covers a substantial portion of the interior of the first frame; a second frame having at least an elastic band, each at least an elastic band having a first end attached to one portion of the second frame, and a second end attached to a second portion of the second frame, wherein the plurality of elastic members create a mesh that covers a substantial portion of the interior of the second frame; wherein the exterior of the first frame and the exterior of the second frame are each connected to a strand and optionally connected to one another.

Figure 9:
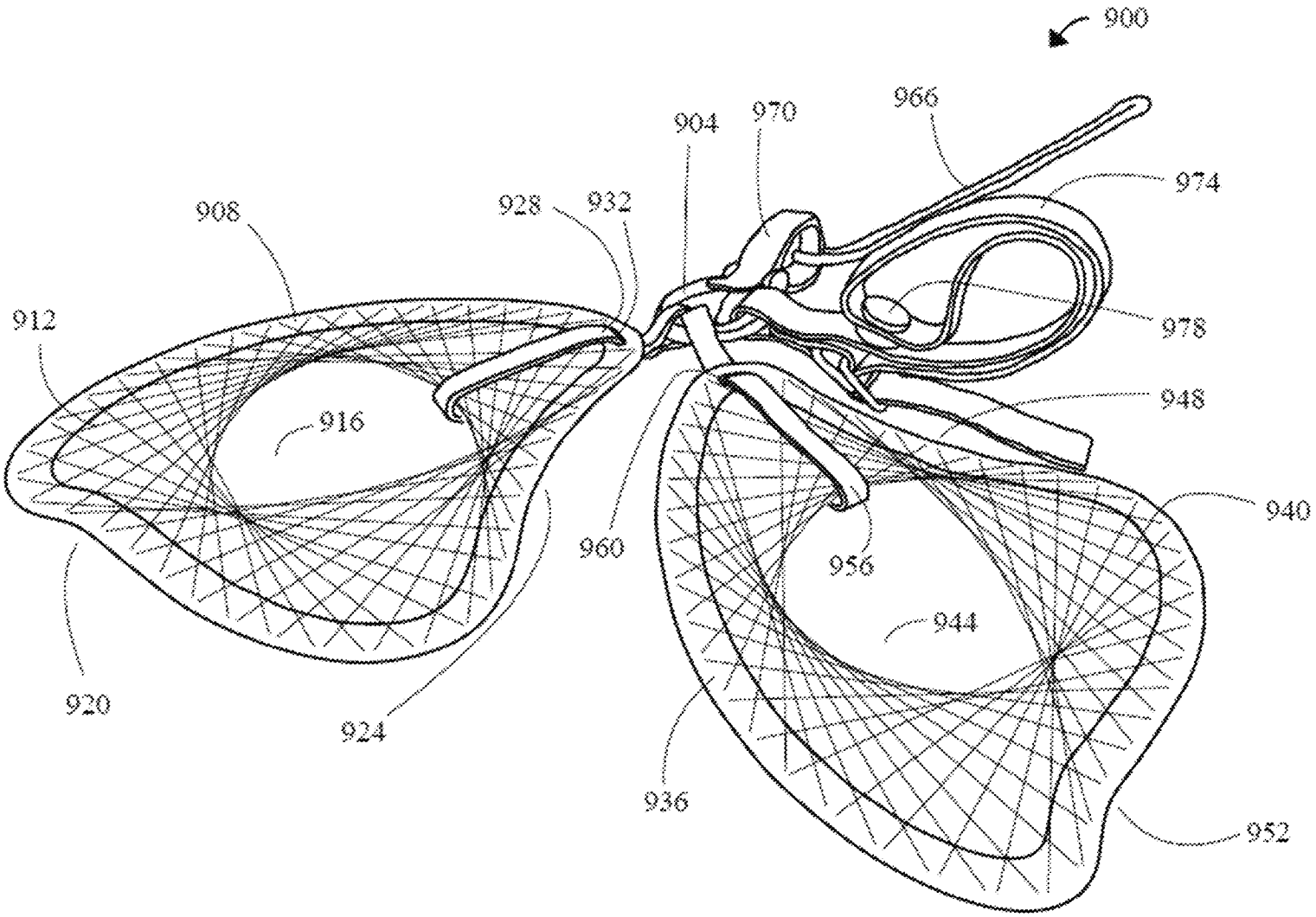
FIG. 9 is an illustration of an exemplary embodiment of a system for carrying foot apparel.

Referring now to FIG. 9, an illustration of an exemplary embodiment of a system 900 for carrying foot apparel is provided. System 900 may include central frame 904. As used herein, a "central frame" is a structural component of a device which connects a first mesh frame to a second mesh frame. Such a connection may be a direct connection, an indirect connection, or a combination thereof. For example, a first mesh frame may be directly connected to central frame 904 and a second mesh frame may be connected to central frame 904 via another component. In some embodiments, central frame 904 may include a ring segment. Ring segment may include a segment of a circular structure. Ring segment may include a structure of a variety of shapes such as a circle, oval, rectangle, pentagon, hexagon, and the like. Ring segment may include a rigid material such as plastic or metal.

Still referring to FIG. 9, system 900 may include first mesh frame 908. As used herein, a "mesh frame" is a structure which supports a mesh of a material which is flexible, elastic, or both, between a first section and a second section of the structure. First mesh frame may include a rigid material such as rigid plastic (e.g., polycarbonate, polyethylene terephthalate, acrylonitrile butadiene styrene, or the like), metal, or wood. First mesh frame may include a semi-rigid material such as rubber or semi-rigid plastics such as high-density polyethylene, polyvinyl chloride, thermoplastic polyurethane, or the like. First mesh frame 908 may provide structure for first mesh 912. First mesh may include a flexible and/or elastic material. In some embodiments, first mesh 912 may include a first at least an elastic band looped around first mesh frame 908 so as to create and/or form a first mesh 912 on the interior of first mesh frame 908. In some embodiments, first at least an elastic band consists of a single elastic band. In some embodiments, first mesh 912 includes first central hole 916. In some embodiments, first mesh 912 includes a first plurality of rim to rim segments, and a majority (i.e., over 50%) of rim to rim segments of the first plurality of rim to rim segments border first central hole 916. In some embodiments, first mesh 912 includes a first plurality of rim to rim segments, and each rim to rim segment of the first plurality of rim to rim segments borders first central hole 916. As used herein, a "rim to rim segment" is a length of material which reaches from a first point on a mesh frame to a second point on the mesh frame, and travels across a space between points on the mesh frame, where the mesh frame does not occupy the space. In some embodiments, first mesh 912 may include a first mesh layer and a second mesh layer. As used herein, a "mesh layer" is a plurality of rim to rim segments, where each of the rim to rim segments travels approximately along the same plane. For example, first mesh layer may be on a first side (i.e., upper side) of first mesh frame 908 and second mesh layer may be on a second side (i.e., lower side) of first mesh frame 908. In some embodiments, the exterior of first mesh frame 908 may include a first concave region 920 and a second concave region 924. As used herein, a "concave region" of a mesh frame is an empty space between 2 points on the mesh frame, where the mesh frame is between a mesh of the mesh frame and the empty space.

Still referring to FIG. 9, system 900 may include a first strap 928. First strap 928 may form a loop from the inside of first central hole 916 to first mesh frame 908. First strap 928 may be attached to central frame 904. For example, first strap 928 may include a loop around central frame 904. In some embodiments, first strap 928 passes through a first meshless hole 932 in first mesh frame 908. Such a design may provide both a sliding system for expanding and/or contracting first central hole 916 and a friction system for holding first strap 928 in place. In some embodiments, a system in which first strap 928 passes through first meshless hole 932 may be replaced by a screw and plug system in which a screw affixes a first segment of first strap 928 to a first side of first mesh frame 908 and inserts into a plug which affixes a second segment of first strap 928 to a second side of first mesh frame 908. Such screw may be inserted into such plug through a hole in first mesh frame 908. Such a design may securely hold first strap 928 in place.

Still referring to FIG. 9, system 900 may include second mesh frame 936. Second mesh frame may include a rigid material such as plastic, metal, or wood. Second mesh frame 936 may provide structure for second mesh 940. Second mesh may include a flexible and/or elastic material. In some embodiments, second mesh 940 may include a first at least an elastic band looped around second mesh frame 936 so as to create and/or form a second mesh 940 on the interior of second mesh frame 936. In some embodiments, second at least an elastic band consists of a second elastic band. In some embodiments, second mesh 940 includes second central hole 944. In some embodiments, second mesh 940 includes a second plurality of rim to rim segments, and a majority of rim to rim segments of the second plurality of rim to rim segments border second central hole 944. In some embodiments, second mesh 940 includes a second plurality of rim to rim segments, and each rim to rim segment of the second plurality of rim to rim segments borders second central hole 944. In some embodiments, first mesh 940 may include a third mesh layer and a fourth mesh layer. For example, third mesh layer may be on a first side of first mesh frame 936 and fourth mesh layer may be on a second side of first mesh frame 936. In some embodiments, the exterior of first frame 936 may include a third concave region 948 and a fourth concave region 952.

Still referring to FIG. 9, system 900 may include a second strap 956. Second strap 956 may form a loop from the inside of second central hole 944 to second mesh frame 936. Second strap 956 may be attached to central frame 904. For example, second strap 956 may include a loop around central frame 904. In some embodiments, second strap 956 passes through a second meshless hole 960 in second mesh frame 936. Such a design may provide both a sliding system for expanding and/or contracting second central hole 944 and a friction system for holding second strap 956 in place. In some embodiments, a system in which second strap 956 passes through second meshless hole 960 may be replaced by a screw and plug system in which a screw affixes a first segment of second strap 956 to a first side of second mesh frame 936 and inserts into a plug which affixes a second segment of second strap 956 to a second side of second mesh frame 936. Such screw may be inserted into such plug through a hole in second mesh frame 936. Such a design may securely hold second strap 956 in place.

Still referring to FIG. 9, in some embodiments, system 900 may further include loop 966. Loop 966 may include a material suitable for carrying system 900 and/or foot apparel attached to system 900. For example, loop 966 may include a material strong enough to support weight of system 900 and/or foot apparel attached to system 900. In some embodiments, loop 966 may include a metal chain. In some embodiments, loop 966 may be removably attached to the rest of system 900 using locking mechanism 970. As used herein, a "locking mechanism" is a component configured to removably attach a loop to a central frame. Central frame 904 may include a ring segment and locking mechanism 970 affixed to the ring segment. Locking mechanism 970 may be affixed to ring segment by, in a non-limiting example, a screw. In some embodiments, locking mechanism may pivot about an axis relative to ring segment. In some embodiments, locking mechanism may automatically close, such as through use of a spring. In some embodiments, a locking mechanism may include a clip and/or clamp design. In a non-limiting example, a locking mechanism may include an upper jaw and a lower jaw where user interaction with a tail of a jaw controls opening and closing of the jaw. Such tail may act as a lever, may be spring loaded, and may be connected to a pivot point. In some embodiments, jaws may be closed, and may securely hold loop 966 when closed. In some embodiments, a user may open jaws by pressing one or more tails, allowing loop 966 to be removed.

Still referring to FIG. 9, in some embodiments, system 900 may include third strap 974. In some embodiments, third strap 974 may be connected to central frame 904, for example, by including a loop around ring segment of central frame 904. In some embodiments, third strap may include closing mechanism 978 such as a button. As used herein, a "closing mechanism" is a component configured to reversibly attach a first point of a strap to a second point of the strap. In some embodiments, first strap 928, second strap 956 and/or third strap 974 may include a flexible material such as leather. In some embodiments, third strap 974 may include an adjustment mechanism. As used herein, an "adjustment mechanism" is a component configured to reversibly lengthen a segment of a strap used to create a loop, reversibly shorten a segment of a strap used to create a loop, or both. In some embodiments, a closing mechanism may include a plurality of D rings.

Still referring to FIG. 9, in some embodiments, system 900 may be configured to engage and/or hold one or more foot apparel items. For example, a first shoe and/or section of a first shoe may be placed within first central hole 916 and may be held in place by first mesh 912, and a second shoe and/or section of a second shoe may be placed within second central hole 944 and may be held in place by second mesh 940. In some embodiments, tightness of first mesh 912 may be modulated by manipulating first strap 928, such as by pulling first strap 928. In some embodiments, tightness of second mesh 940 may be modulated by manipulating second strap 956, such as by pulling second strap 956. In another example, third strap 974 may be fed through laces of one or more shoes and may be closed using closing mechanism 978. Third strap 974 may be used, in non-limiting examples, when foot apparel is too large to fit in a central hole and/or when one wishes to carry multiple foot apparel items.

Still referring to FIG. 9, in some embodiments, system 900 may include only a single mesh frame. In some embodiments, system 900 may include a plurality of mesh frames, such as 2, 3, 4, 5, 6, or more mesh frames. In some embodiments, each mesh frame of a plurality of mesh frames is configured to hold and/or removably engage with foot apparel, such as 1 foot apparel per mesh frame. In some embodiments, a single mesh frame may removably engage with a plurality of foot apparel. In a non-limiting example, heels of 2 high heel shoes may be placed in a central hole of a single mesh, such that a single mesh and mesh frame is used to engage both shoes.

Figure 10:
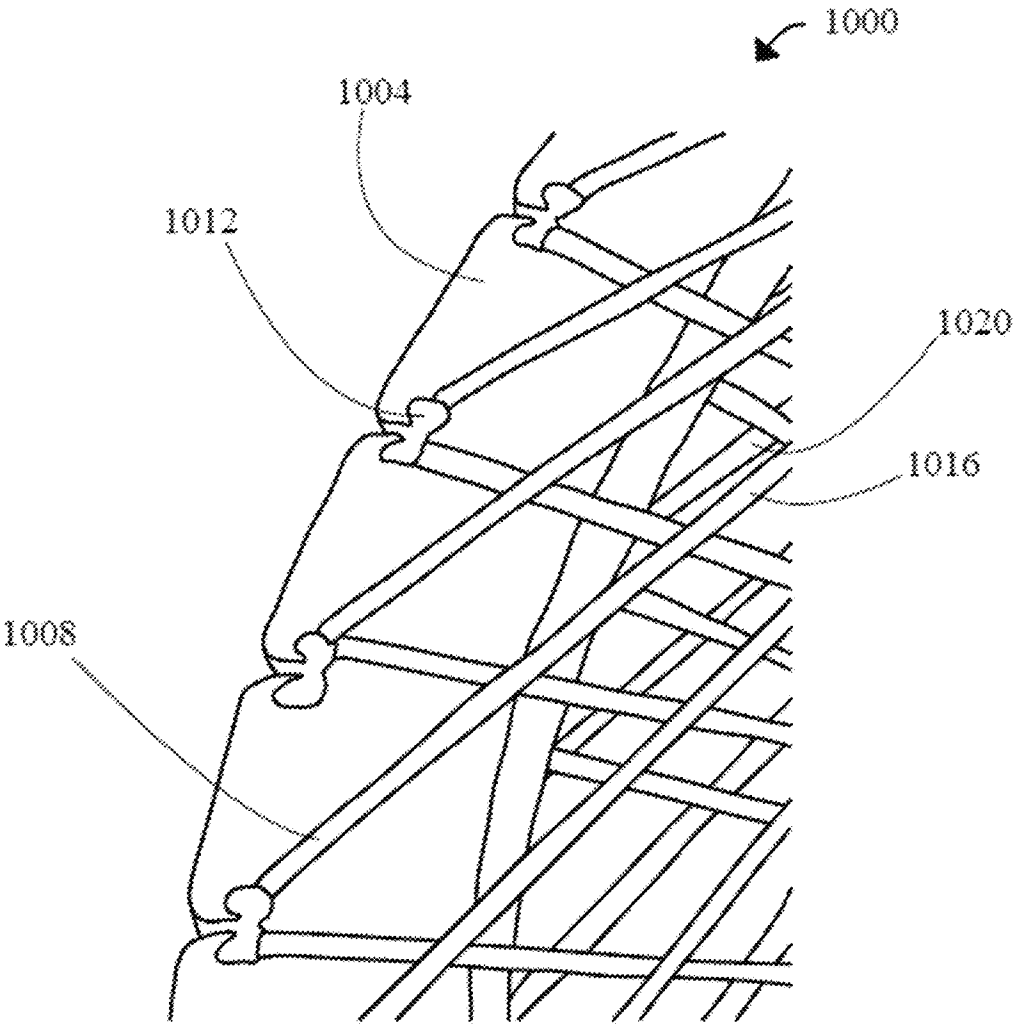
FIG. 10 is an illustration of an exemplary embodiment of a section of a system for carrying foot apparel.

Referring now to FIG. 10, a zoomed in view of a section of system 1000 is provided. In some embodiments, system 1000 may include mesh frame 1004. Mesh frame 1004 may support a mesh including at least an elastic band 1008. At least an elastic band 1008 may pass through one or more elastic band cutouts 1012 of mesh frame 1004. Elastic band cutouts 1012 may allow for removal of at least an elastic band 1008 in the case that, in non-limiting examples, tension of at least an elastic band 1008 needs to be adjusted, at least an elastic band 1008 requires cleaning or at least an elastic band 1008 requires repair. Elastic band cutouts 1012 may hold at least an elastic band 1008 in place so as to maintain a mesh of a desired shape and/or pattern. In some embodiments, mesh frame 1004 may include a plurality of elastic band cutouts 1012. In some embodiments, mesh supported by mesh frame 1004 may include first mesh layer 1016 and second mesh layer 1020.

Still referring to FIG. 10, in some embodiments, a mesh of a mesh frame is formed using a single elastic band. In some embodiments, a mesh of a mesh frame may be formed by looping at least an elastic band 1008 from elastic band cutout to elastic band cutout in an approximately triangular pattern. For example, at least an elastic band may travel from a first elastic band cutout on a first side of a mesh frame to a second elastic band cutout on the first side of the mesh frame, through the second elastic band cutout to the second side of the mesh frame, to a third elastic band cutout on the second side of the mesh frame, through the third elastic band cutout to the first side of the mesh frame, and to a fourth elastic band cutout, where the fourth elastic band cutout is adjacent to the first elastic band cutout. In some embodiments, such first, second, and third elastic band cutouts may be positioned such that there are an equal, or approximately equal, number of elastic band cutouts between them. In some embodiments, at least an elastic band may travel around a mesh frame in this way, with each loop incrementing the elastic band cutout number at each point of the triangle by 1. In some embodiments, such a pattern may be done twice, such that each elastic band cutout has 2 segments of elastic band running through it, each travelling to a different elastic band cutout. In some embodiments, at least an elastic band may include a length of elastic material closed together to form a loop, such as through use of a knot or an adhesive. In some embodiments, a position at which a length of elastic material is closed may be positioned in elastic band cutout 1012.

Figure 11:
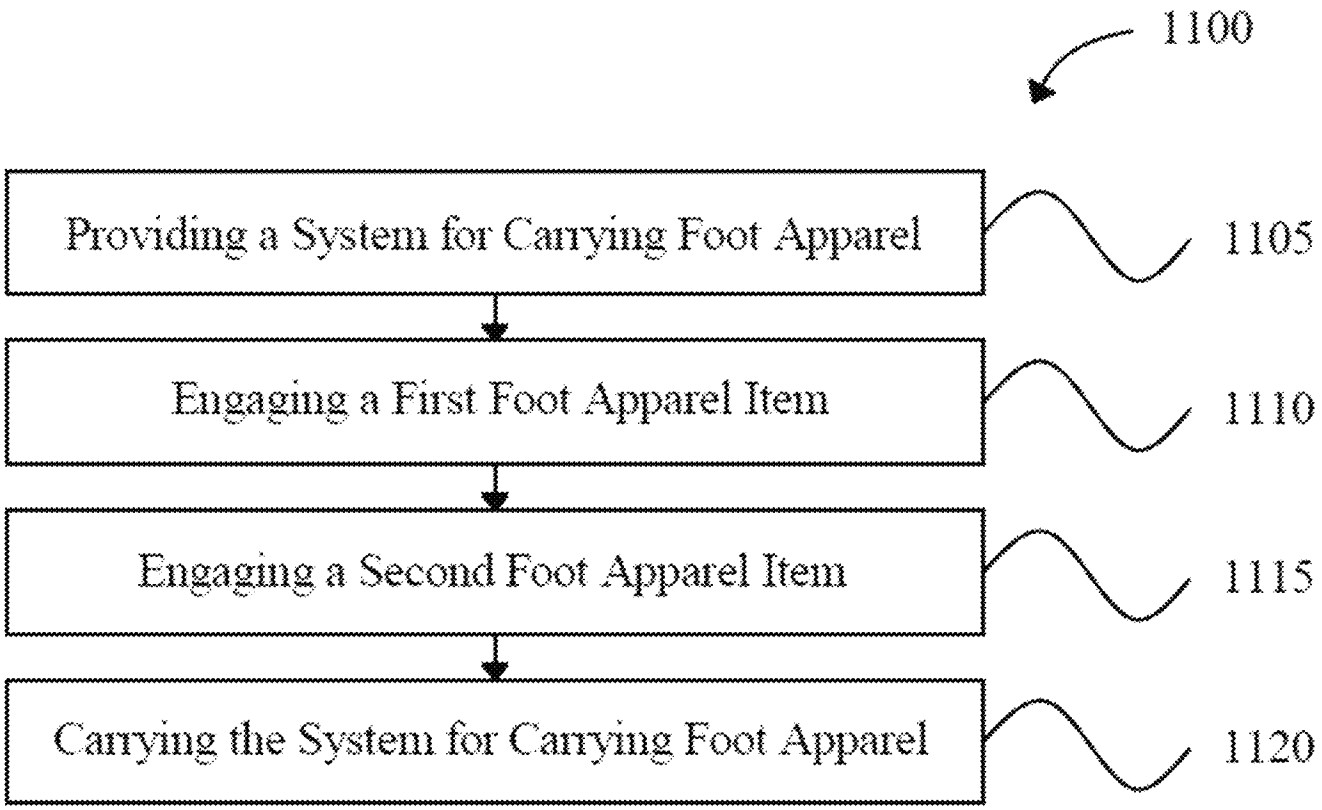
FIG. 11 is a flow diagram depicting an exemplary embodiment of a method of carrying foot apparel.

Referring now to FIG. 11, an exemplary embodiment of a method 1100 of carrying foot apparel is illustrated. One or more steps if method 1100 may be implemented, without limitation, as described with reference to other figures. One or more steps of method 1100 may be implemented, without limitation, using at least a processor.

Still referring to FIG. 11, in some embodiments, method 1100 may include providing a system for carrying foot apparel 1105. A system for carrying foot apparel may include a central frame; a first mesh frame; a first at least an elastic band looped around the first mesh frame so as to create a first mesh on the interior of the first mesh frame, wherein the first mesh comprises a first central hole; a first strap which forms a loop from the inside of first central hole to the first mesh frame, and which is attached to the central frame; a second mesh frame; a second at least an elastic band looped around the second mesh frame so as to create a second mesh on the interior of the second mesh frame, wherein the second mesh comprises a second central hole; and a second strap which forms a loop from the inside of second central hole to the second mesh frame, and which is attached to the central frame. In some embodiments, the first mesh includes a first plurality of rim to rim segments; a majority of rim to rim segments of the first plurality of rim to rim segments border the first central hole; the second mesh includes a second plurality of rim to rim segments; and a majority of rim to rim segments of the second plurality of rim to rim segments border the second central hole. In some embodiments, the first mesh includes a first plurality of rim to rim segments; each rim to rim segment of the first plurality of rim to rim segments borders the first central hole; the second mesh includes a second plurality of rim to rim segments; and each rim to rim segment of the second plurality of rim to rim segments borders the second central hole. In some embodiments, the exterior of the first frame includes a first concave region and a second concave region; and the exterior of the second frame includes a third concave region and a fourth concave region. In some embodiments, the first at least an elastic band consists of a single elastic band; and the second at least an elastic band consists of a single elastic band. In some embodiments, the first mesh includes a first mesh layer and a second mesh layer; and the second mesh includes a third mesh layer and a fourth mesh layer. In some embodiments, the first strap passes through a first meshless hole in the first mesh frame; and the second strap passes through a second meshless hole in the second mesh frame. In some embodiments, the central frame includes a ring segment; and a locking mechanism affixed to the ring segment. In some embodiments, the system further includes a loop removably connected to the locking mechanism. In some embodiments, the system further includes a third strap connected to the central frame; and the third strap includes a closing mechanism.

Still referring to FIG. 11, in some embodiments, method 1100 may further include engaging a first foot apparel item using the first mesh 1110; engaging a second foot apparel item using the second mesh 1115; and/or carrying the system for carrying foot apparel 1120.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and devices according to the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An apparatus for carrying foot apparel, the apparatus comprising:

a central frame;

a first mesh frame;

a first elastic band looped around the first mesh frame forming a first mesh on the interior of the first mesh frame, wherein the first mesh comprises a first central hole;

a first strap which forms a loop from the inside of the first central hole to the first mesh frame, and which is attached to the central frame;

a second mesh frame;

a second elastic band looped around the second mesh frame forming a second mesh on the interior of the second mesh frame, wherein the second mesh comprises a second central hole; and a second strap which forms a loop from the inside of the second central hole to the second mesh frame, and which is attached to the central frame.

2. The apparatus of claim 1, wherein;

the first mesh is configured to removably engage with a first foot apparel placed in the first central hole; and the second mesh is configured to removably engage with a second foot apparel placed in the second central hole.

3. The apparatus of claim 1, wherein:

the first mesh comprises a first plurality of rim to rim segments;

at least 50% of rim to rim segments of the first plurality of rim to rim segments borders the first central hole;

the second mesh comprises a second plurality of rim to rim segments; and at least 50% of rim to rim segments of the second plurality of rim to rim segments borders the second central hole.

4. The apparatus of claim 1, wherein:

the first mesh comprises a first plurality of rim to rim segments;

each rim to rim segment of the first plurality of rim to rim segments borders the first central hole;

the second mesh comprises a second plurality of rim to rim segments; and each rim to rim segment of the second plurality of rim to rim segments borders the second central hole.

5. The apparatus of claim 1, wherein:

the exterior of the first frame comprises a first concave region and a second concave region; and the exterior of the second frame comprises a third concave region and a fourth concave region.

6. The apparatus of claim 1, wherein:

the first at least an elastic band consists of a single elastic band; and the second at least an elastic band consists of a single elastic band.

7. The apparatus of claim 1, wherein:

the first mesh comprises a first mesh layer and a second mesh layer; and the second mesh comprises a third mesh layer and a fourth mesh layer.

8. The apparatus of claim 1, wherein:

the first strap passes through a first meshless hole in the first mesh frame; and the second strap passes through a second meshless hole in the second mesh frame.

9. The apparatus of claim 1, wherein the central frame comprises:

a ring segment;

a locking mechanism affixed to the ring segment; and a loop removably connected to the locking mechanism.

10. The apparatus of claim 1, wherein:

the apparatus further comprises an additional strap connected to the central frame; and the additional strap comprises a closing mechanism.

11. An apparatus of carrying foot apparel, the apparatus comprising:

a central frame;

at least one mesh frame;

at least an elastic band looped around the at least one mesh frame, forming a mesh on the interior of the at least one mesh frame, wherein the mesh comprises a central hole; and at least a strap which forms a loop from the inside of the central hole to the at least one mesh frame, and which is attached to the central frame.

12. The apparatus of claim 11, wherein the mesh is configured to removably engage with a foot apparel placed in the central hole.

13. The apparatus of claim 11, wherein:

the mesh comprises a plurality of rim to rim segments; and at least 50% of rim to rim segments of the plurality of rim to rim segments borders the central hole.

14. The apparatus of claim 11, wherein:

the mesh comprises a plurality of rim to rim segments; and each rim to rim segment of the plurality of rim to rim segments borders the central hole.

15. The apparatus of claim 11, wherein the exterior of the frame comprises a first concave region and a second concave region.

16. The apparatus of claim 11, wherein the at least an elastic band consists of a single elastic band.

17. The apparatus of claim 11, wherein the mesh comprises a first mesh layer and a second mesh layer.

18. The apparatus of claim 11, wherein the strap passes through a meshless hole in the mesh frame.

19. The apparatus of claim 11, wherein the central frame comprises:

a ring segment;

a locking mechanism affixed to the ring segment; and a loop removably connected to the locking mechanism.

20. The apparatus of claim 11, wherein:

the apparatus further comprises an additional strap connected to the central frame; and the additional strap comprises a closing mechanism.

* * * * *